United States Patent [19]

James et al.

[11] Patent Number: 4,821,487

[45] Date of Patent: Apr. 18, 1989

[54] EASY-OPEN CASE TAPING

[75] Inventors: Robert C. James, Sheboygan, Wis.; Richard J. Pederson, Richfield, Minn.

[73] Assignee: Bemis Company, Inc., Minneapolis, Minn.

[21] Appl. No.: 109,748

[22] Filed: Oct. 19, 1987

Related U.S. Application Data

[62] Division of Ser. No. 876,848, Jun. 20, 1986, abandoned.

[51] Int. Cl.[4] ..... B65B 61/18

[52] U.S. Cl. ..... 53/412; 53/133; 53/137; 53/415; 156/477.1

[58] Field of Search ..... 53/133, 137, 412, 415; 156/468, 475, 477.1, 486; 493/963

[56] References Cited

U.S. PATENT DOCUMENTS

| | | | |
|---|---|---|---|
| 3,355,995 | 12/1967 | Borkmann et al. | 493/963 X |
| 3,466,843 | 9/1969 | Mumper | 53/137 |
| 3,901,757 | 8/1975 | Eglinton | 156/522 X |
| 4,227,955 | 10/1980 | Woods et al. | 156/522 X |

*Primary Examiner*—Robert L. Spruill
*Assistant Examiner*—Beth Tenney
*Attorney, Agent, or Firm*—Senniger, Powers, Leavitt and Roedel

[57] ABSTRACT

A case sealed by a strip of pressure-sensitive tape having an integral end portion of the tape at an end thereof folded back on the adhesive face of the tape and adhered thereto to form a tab which is unadhered to the case for being grasped and pulled to peel the tape away from the case, and a method of and apparatus for taping cases with this easy-open feature.

19 Claims, 5 Drawing Sheets

EASY-OPEN CASE TAPING

This is a, division of application Ser. No. 876,848, filed June 20, 1986 abandoned.

This invention relates to easy-open case taping, and more particularly to a method of and apparatus for taping a case with the tape having an easy-open feature.

The invention is especially concerned with the taping of a case made of paperboard or the like having a closure (e.g. a top) comprising two folded-over flaps, such as two side flaps folded over from the sides of the case on end flaps folded in from the ends of the case, and having adjoining parallel edges extending generally along the center line of the closure. Heretofore, such closures have been conventionally completed by applying an adhesive tape to the margins of the two side flaps along said edges, the tape extending throughout the length of said closure of the case and part way along the ends of the case, being adhered to the side flaps and the ends of the case completely throughout its length. Removal of the tape for opening up the side flaps to open the case has been difficult, if not impossible, and generally the case is opened by slitting the tape between the adjacent edges of the side flaps.

The object of this invention is to provide a case having a strip of tape adhered to the margins of the side flaps along the edges of the side flaps but with the tape having an easy-open feature whereby an end of the tape may be readily grasped and pulled to peel the tape away from the case for opening it, thereby eliminating the need for slitting the tape.

In general, according to the invention, the easy-open feature involves the provision of a tab at one end of the tape formed by folding back an end portion of the tape on the adhesive face of the tape and adhering the folded-back portion to the tape, the tab being unadhered to the case for being grasped and pulled to peel the tape away from the case.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
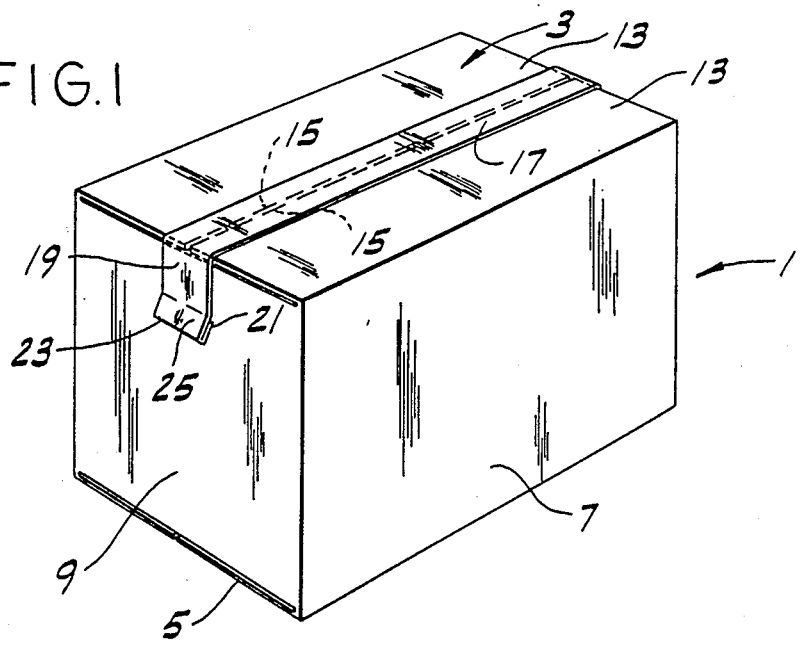
FIG. 1 is a perspective of a case with a tape provided with the easy-open feature according to this invention.
Figure 2:
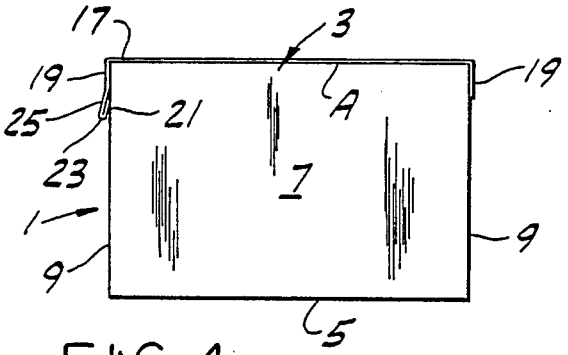
FIG. 2 is a side elevation of FIG. 1.
Figure 3:
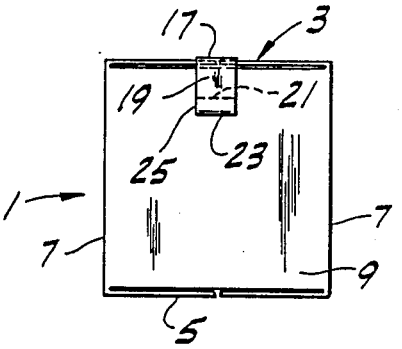
FIG. 3 is an end elevation of FIG. 2 as viewed from the left of FIG. 2.
Figure 4:
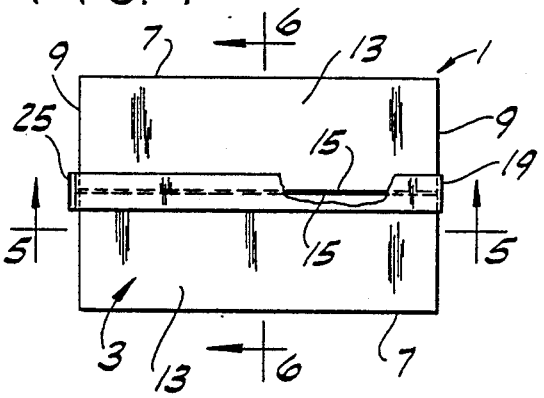
FIG. 4 is a plan of FIG. 2 with the tape partly broken away.

Referring to the drawings, there is generally indicated at 1 a case (or carton) made of paperboard or the like, e.g. corrugated box board, having a top 3, bottom 5, sides each designated 7 and ends each designated 9. The top 3 is illustrated as a top closure such as is conventionally formed, after the case has been packed, by folding two end flaps each designated 11 over from the top of the case ends 9 on top of product packed in the case, and then folding over two side flaps each designated 13 from the top of the case sides 7 on top of the end flaps. The side flaps 13, when completely folded over, are generally coplanar and have adjoining parallel edges each designated 15 which may be generally in abutting relation or closely adjacent relation. The flaps 13 are secured together along said edges 15 by a strip of tape 17, more particularly a strip of pressure-sensitive tape of a type conventionally used for taping cases, having pressure-sensitive adhesive on one face A thereof by means of which the strip of tape is adhered to the margins of the flaps 13 along said edges 15. The strip of tape extends throughout the length of the top 3 of the case, and has portions 19 extending down on the outside of the ends 9 of the case for some distance. The bottom closure 5 generally also comprises end flaps and side flaps, like the top closure, these flaps being secured in suitable manner. They may be taped, like the top closure.

In accordance with this invention, for providing an easy-open feature, the tape has at least at one end thereof, i.e. at the lower end of one of the downwardly extending portions 19, an integral end portion 21 folded over on a line 23 extending across the tape from one side thereof to the other and generally at right angles to the side edges of the tape, with the adhesive on said folded-over end portion 21 on the inside of said end portion 21 and with said end portion 21 flattened and adhered by the adhesive to the tape to form a tab indicated at 25 at said one end of the tape which is unadhered to the end of the case and thus free of the end of the case for being grasped and pulled to peel the tape throughout its length away from the flaps 13 of the case.

In accordance with this invention, the tab 25 for grasping the tape and peeling it away from the case is formed during the operation of applying the tape to the case as illustrated in FIGS. 10–13. As shown therein, basically, a continuous length of tape T having the adhesive A on said one face thereof is fed forward (down) from a supply, more particularly a roll 27 of the tape, and applied to a case 1 as the case is fed forward (toward the left as viewed in FIGS. 10–13) endwise along a horizontal path by a case conveyor 29, the tape being adhered by the said adhesive first to a portion of the leading end 9 and then to the margins of the flaps 13 along the edges 15 of the flaps. The continuous length of tape is severed to supply the strip 17 of sufficient length to provide for end portions 19 of the tape extending down on the ends 9 of the case. Before the application of the tape to the case, the integral end portion 21 of the tape is bent up and the bent-up end portion 21 is adhered by the adhesive on the tape to the tape to form the tab 25. The tape T is guided to extend down from the supply roll 27 with the tape at its lower end extending down into the path of a case 1 being fed forward in the stated horizontal path by the conveyor 29, and with the adhesive face A of the tape facing the oncoming leading end 9 of the case.

Figures 8, 9:
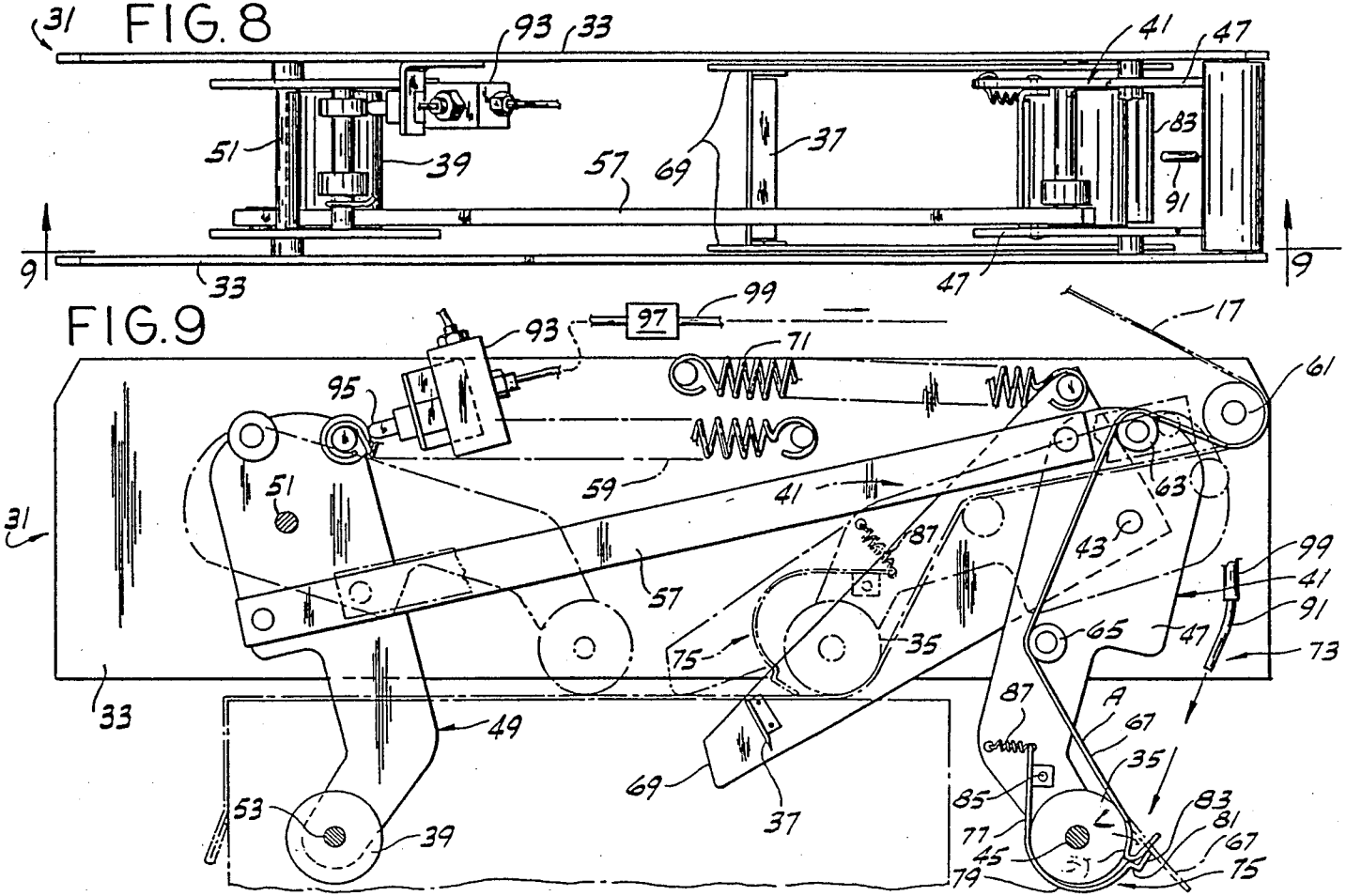
FIG. 8 is a plan of the head of taping apparatus having incorporated therein means of this invention for providing the tape with the easy-open feature of this invention.
FIG. 9 is a vertical longitudinal section of the head generally on line 9—9 of FIG. 8.

The conveyor 29 is operable to feed a case 1 to be taped forward under a taping head indicated generally at 31. The taping head, which is suitably fixed in position above the conveyor at a taping station along the length of the conveyor, applies pressure-sensitive adhesive tape issuing from the tape supply roll 27, which is suitably mounted above the head, to the case as the case is fed forward under the head. As shown in FIGS. 8 and 9, the head comprises a frame including a pair of side plates each designated 33. A first presser means comprising a roller 35 is provided for pressing the tape against the leading end of a case 1 and then down on the top 3 of the case over the length of the case as the case is fed forward on the conveyor 29 under the taping head 31. At 37 is indicated a knife for cutting the tape. A second presser means comprising a roller 39 is provided for continuing the pressing of the tape, down on the top of the case over the length of the tape, and, after the tape has been cut by the knife, against the trailing end 9 of the case. Roller 35 is mounted at one end, constituting the lower end, of a two-sided lever 41 pivoted for swinging movement on a horizontal transverse axis at 43 between the side plates 33. The roller 35 is free-rolling on a pin 45 extending horizontally between the sides 47 of lever 41 at its said lower end. Roller 39 is mounted at one end, constituting the lower end, of a two-sided lever 49 pivoted for swinging movement on a horizontal transverse axis at 51 between the plates 33 downstream (in relation to the travel of a case 1) from lever 41 and roller 35. The roller 39 is free-rolling on a pin 53 extending horizontally between the sides 55 of lever 49 at its lower end.

The levers 41 and 49 are interconnected by a link 57 for conjoint movement, and are biased by a spring 59 connected to lever 49 to swing down to the lowered retracted position in which each of the rollers 35 and 39 is illustrated in solid lines in FIG. 9 wherein they are below the plates 33 and in the path of a case 1 being fed forward on the conveyor. The first roller 35 is adapted to swing up with lever 41 in clockwise direction as viewed in FIG. 9 from its lowered position, and, acting through the link 57, thereupon swings the lever 49 carrying roller 39 in the opposite direction, i.e. counterclockwise, raising the roller 39 out of the path of the case. On such upswing of the levers 41, 49 and rollers 35, 39, spring 59 is tensioned and biases the levers to swing back down. The tape T is trained to extend from the supply roll 27 down through the head frame around a, guide roll 61 extending between the side plates 33 and thence around guide rolls 63 and 65 extending between the sides 47 of lever 41 to have a lower end reach indicated at 67 in FIG. 9 extending downwardly and rearwardly at the front (the upstream side) of the first presser roller 35 between the latter and the oncoming leading end 9 of a case 1 being fed forward on conveyor 29 toward roller 35.

The knife 37 is carried by a two-sided lever 69 pivoted for swinging movement at 43, the two sides of lever 69 being on the outside of sides 47 of lever 41 and inside side plates 33. The lever 69 is biased to swing down by a spring 71 to the position shown in solid lines in FIG. 9 wherein the knife is below the plates 33, and is adapted to be swung up against the spring bias by a case 1 fed forward on conveyor 29, the spring snapping the lever back down when the case passes out of engagement with the lever, for severing of the tape by the knife.

The taping head as thus far described is generally the same as that of a case taping machine which has been on the market by Bemis Company, Inc. of Minneapolis, Minn., under the name BEMISTAPER. In accordance with this invention, the taping head 31 is provided with means generally designated 73 for folding up integral end portion 21 of the stated lower end reach 67 of the tape for the formation of the tab 25. As shown in FIG. 9, this means comprises a pocket-forming member 75, formed from a piece of sheet metal, generally in the shape of a J (as viewed from one side) having a straight leg 77, an arcuate foot 79 shaped in accordance with the presser roller 35, and a toe portion on the foot comprising an outwardly extending relatively narrow web 81 and a flange or lip 83 extending up from the web at its outer edge. This pocket-forming member 75 has its straight leg 77 pivoted for swinging movement on a horizontal transverse axis at 85 between the sides 47 of the lever 41 above the roller 35, and is biased by a spring 87 to swing to the position in which it is illustrated in solid lines in FIG. 9 wherein its leg 77 engages the back (the downstream side) of the roller 35, with the curved foot 79 extending around the bottom of the roller 35, and with the web 81 and flange 83 at the front (the upstream side) of the roller 39 forming an upwardly facing recess or pocket 89 at the front of the roller, the back of this pocket being defined by the roller itself, and the bottom of the pocket being defined by the web 81, and the front of the pocket being defined by the flange 83 as best shown in FIG. 9. The stated lower end reach 67 of the tape T is shown in phantom in FIG. 9 extending down over the front of the roller 35 and thence over the pocket, prior to being forced into the pocket as will appear.

The tape folding means 73 further comprises means for forcing the tape into the pocket 89 and thereby initiating the folding thereof to form the tab, this means comprising a nozzle 91 for delivering a blast of air on the portion of the tape which extends over the pocket to blow that portion into the pocket, thereby forming a loop L of the tape in the pocket with the front side of the loop (the side away from the roller 35) constituting the stated end portion 21 of said end reach 67 of the tape bent up on the inside of the flange and extending up beyond the flange for a relatively short distance, the other side of the loop extending up on the front of the roller 35. Delivery of the air blast via the nozzle is under control of a control valve 93 which in turn is under control of the presser roll mechanism by means of engagement of the lever 49 at its upper end with an actuator 95 for the valve 93. This controls the supply of air under pressure from a source (not shown) to a valve 97 which, on delivery of control air thereto from valve 93, acts to deliver a shot of air from the source of air to the nozzle 91 via a line 99, the arrangement being such that on actuation of the valve 93 by the lever 49 as it returns to its home position of FIG. 9, a blast of air is delivered through the nozzle.

Figure 10:
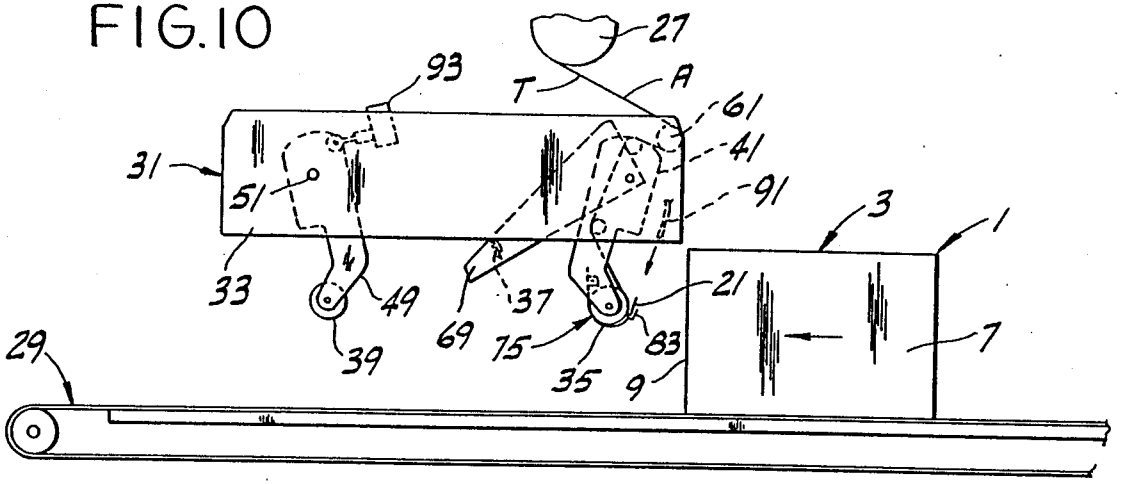
FIGS. 10–13 are generally diagrammatic views showing further features of the apparatus and its sequence of operation.
Figure 11:
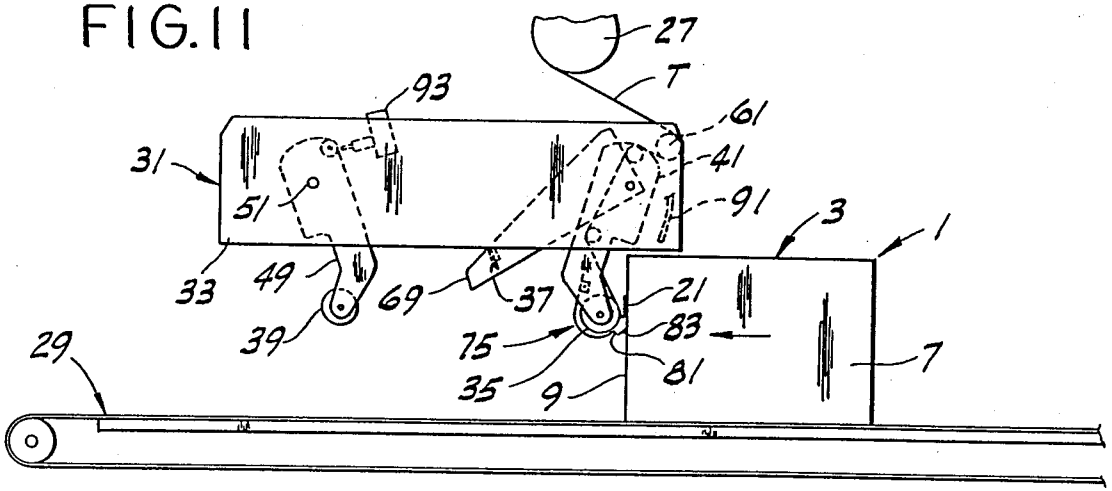

At the start of each application of tape to a case 1, the presser rollers 35 and 39 and the knife 37 are all down in the lowered position in which they are shown in solid lines in FIG. 9, also being shown in this position in FIG. 10. Tape T from the supply roll 27 of tape extends from the supply roll around guide rolls 61, 63 and 65 with the lower end reach 67 of the tape extending in front of the roller 35, the adhesive side A of the tape facing away from the roller 35, toward the leading end 9 of a case 1 to be fed forward on the conveyor 29, the end of the tape having been formed as a result of the previous taping application into the loop L in the pocket 89 (see FIGS. 9 and 10).

The case 1 to be taped is fed forward on the conveyor 29 toward the first presser roller 35 as illustrated in FIG. 10. As the case is fed forward, its leading end 9 substantially simultaneously engages both the exposed portion of the tape 21 and the top of the upturned flange 83 on the top on the arcuate foot 79 of the pocket-forming member 75, and swings the member 75 clockwise on its pivot 85 against the return bias of spring 87 so that the flange 83 is swung away from in front of the upwardly extending end portion 21 of the lower end reach 67 of the tape (see FIG. 11). On continued movement of the case 1, the leading end 9 of the case engages the bent-up end portion 21 then presses it against part of the tape immediately adjacent portion 21, thereby to squeeze together portion 21 and said adjacent part of the tape so that they become securely adhered together by the adhesive on the tape and form the tab 25 with the outside (the non-adhesive side) of portion 21 included in the tab facing the leading end of the case.

On further forward progression of the case 1, the leading end 9 of the case, engaging the outside of the upwardly folded end portion 21 of the tape and the adhesive side of the lower end reach 67 of the tape above end portion 21 where the adhesive is exposed, pushes against the roller 35 so that the lower end reach of the tape is securely adhered to the leading end of the case. The lever 41 carrying the roller 35 is swung up (clockwise) against the bias of spring 59, the roller 35 riding up the leading end of the case, and then riding on the tape on top of the case to press the tape down on top of the flaps 13.

Figure 12:
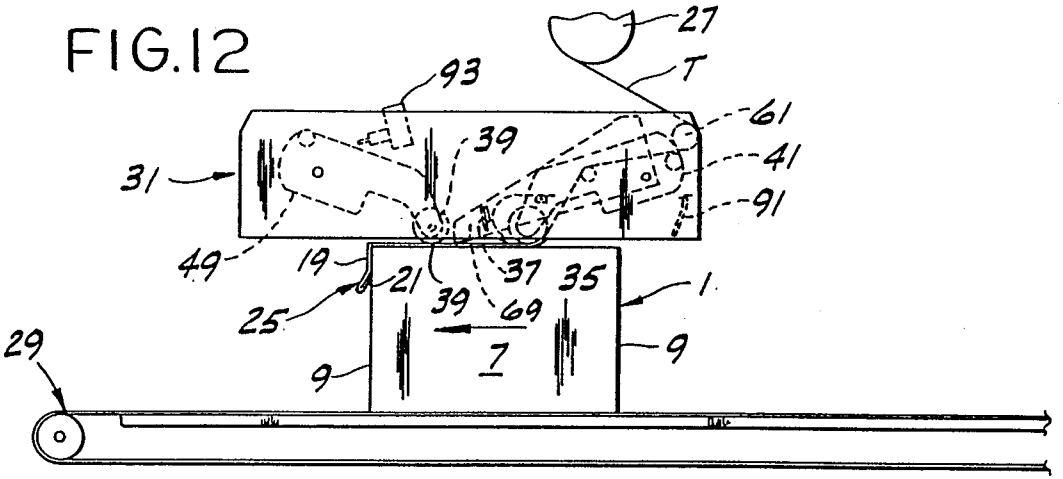
Figure 13:
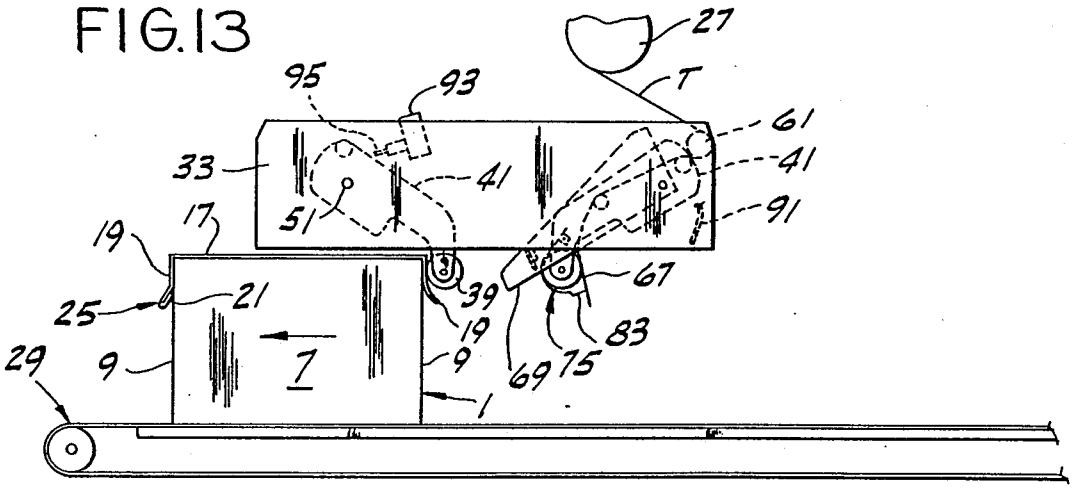

On upward swing of the lever 41 carrying roller 35, lever 49 carrying roller 39 is swung up (counterclockwise) against the bias of spring 59 by the link 57 to the raised position shown in phantom in FIG. 9 and in dotted lines in FIG. 12 to clear the way for the travel of the case past the roller 39. Also, as the leading end 9 of the case moves on past the roller 35, it engages the lower ends of the sides of the knife lever 69 and swings this lever up against the bias of spring 71 to the raised position in which the lever is shown in phantom in FIG. 9 and in dotted lines in FIG. 12, the lever being held up in the raised position by engagement with the top of the case. Then when the case passes by the lower end of the lever 69, the lever 69 is snapped down by the spring 71 for the knife 37 to sever the tape with the length of the strip 17 of tape so severed from the continuous strip T of tape such as to provide for portion 19 of the tape to extend down on the trailing end of the case.

Both rollers 35 and 39 remain up until the trailing end 9 of the case clears the roller 39. The lever 49 then swings down (clockwise) under the bias of the spring 59, and presses the trailing end or tail of the cut-off strip 17 of the tape against the trailing end of the case, rolling down on the tape on the trailing end of the case (see FIG. 13). As the lever 49 swings down, lever 41 swings down to return the roller 35 to its home position in which it is illustrated in solid lines in FIGS. 9 and 10.

As the case 1 moves forward with the tape T adhered thereto, it acts to pull the tape T from the supply roll 27, and just before the case passes by the lower end of the knife lever 69, there is a horizontal reach of tape extending from the bottom of roller 35 over the top of the case. As shown in phantom in FIG. 9, the pocket-forming member 75 is held back in a retracted position relative to the roller 35 against the bias of spring 87 by this reach of tape on top of the case engaging the flange 83. When the tape is cut, and the lever 41 and roller 35 return to home position, the pocket-forming member 75 is returned by the spring 87 to the pocket-forming position in which it appears in solid lines at the lower right of FIG. 9, and the lower end reach 67 of tape is reestablished extending over the pocket 89 as shown in phantom in FIG. 9. At the end of the return, lever 49 activates valve 93 and so that a blast of air is delivered through nozzle 91 to tuck the tape into the pocket 89 to form the loop L, and thus the end of the tape is prepared for taping the next case.

Figure 7:
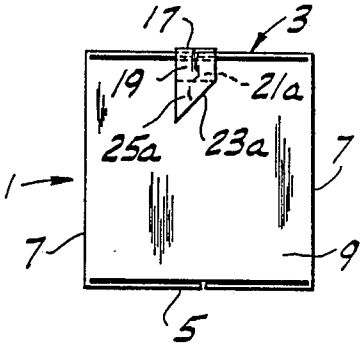
FIG. 7 is a view showing a modification of the easy-open feature.
Figure 5:
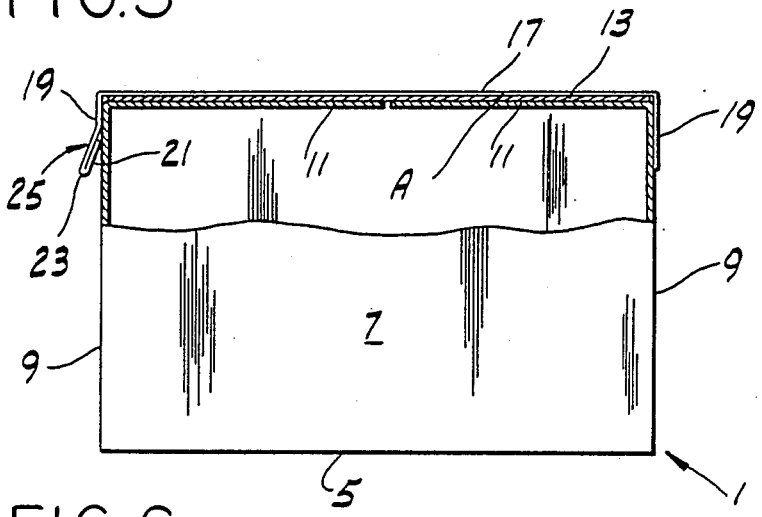
FIG. 5 is an enlarged vertical longitudinal section on line 5—5 of FIG. 4.
Figure 6:
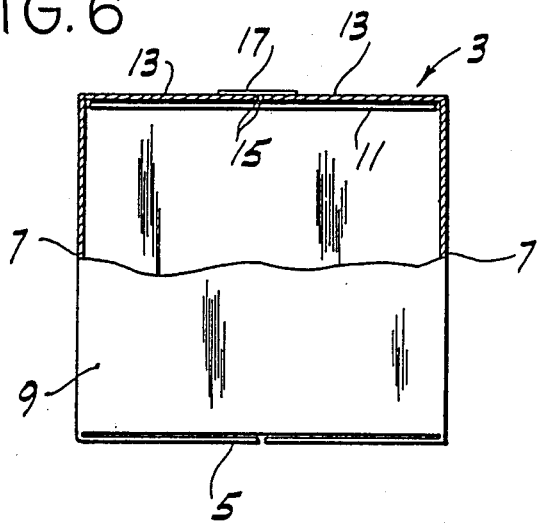
FIG. 6 is an enlarged vertical transverse section on line 6—6 of FIG. 4.

FIG. 7 shows a modification wherein the end portion of the tape, here designated **21*a*, is folded back on a line 23*a* generally at a 45° angle to the edges of the tape (instead of at right angle) forming a tab designated 25*a***.

It is contemplated that the strip of tape may have a tab such as 25 or **25*a*** at both ends. Also, while the invention as above described involves use of a pressure-sensitive adhesive tape, it is contemplated that a remoistening gummed tape may be used, the gluing medium on the tape being used to form the tab.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of taping a case having a closure comprising two folded-over flaps having adjoining edges, said method comprising pressing a strip of tape having adhesive on one face thereof against the margins of said flaps along said adjoining edges to adhere the tape to said margins, and wherein, prior to pressing the tape against said flaps, an integral end portion of the tape is folded back on said face of the tape and adhered thereto to form a tab which is unadhered to the case for being grasped and pulled to peel the tape away from the case, and wherein the case is fed forward in a predetermined path with said adjoining edges extending in the direction of feed, a continuous length of tape is guided from a supply thereof toward said path for pressing of the tape against the case to adhere it to said margins as the case is fed forward in said path, the tape being pulled from the supply by the case, and the tape is severed transversely following its adherence to said margins to provide a length thereof for adherence to said margins along said adjoining edges, said integral end portion of the tape being at least partially folded back on said face of the tape prior to the pressing of the tape against the case adjacent said integral end portion of the tape.

2. The method of claim 1 wherein said integral end portion of the tape is at the leading end of the tape.

3. The method of claim 2 wherein the leading end of the case engages said integral end portion of the tape.

4. The method of claim 3 wherein the leading end of the tape is partially folded back before engagement thereof by the leading end of the case and the folding is completed by engagement of the leading end of the case with the partially folded leading end of the tape.

5. The method of taping a case having a closure comprising two folded-over flaps having adjoining edges, said method comprising pressing a strip of tape having adhesive on one face thereof against the margins of said flaps along said adjoining edges to adhere the tape to said margins, and wherein, prior to pressing the tape against said flaps, an integral end portion of the tape is folded back on said face of the tape and adhered thereto to form a tab which is unadhered to the case for being grasped and pulled to peel the tape away from the case, the case having a top constituting the said closure, a bottom, sides and ends, the flaps and their said adjoining edges extending endwise of the case, wherein the case is fed forward endwise toward an end reach of a continuous length of tape issued from a supply thereof, the tape being disposed with the adhesive face thereof in said end reach facing the leading end of the case and being generally centered with respect to said flaps, said integral end portion of the tape being constituted by an end portion of said end reach, said end portion, when folded back, leaving exposed the adhesive on the adjacent part of said end reach, and wherein the pressing of the tape after the folding back of said integral end portion of said end reach of the tape involves pressing said reach of the tape including said folded-back portion and said adjacent part of said reach against the leading end of the case as the case moves forward, pressing the tape down on top of the flaps, servering the tape to provide a length thereof sufficient to extend down on the trailing end of the case, and pressing the tape down on the trailing end of the case, leaving a new end reach of the tape issuing from the supply for being so folded at its end and engaged with and by the leading end of the next case.

6. The method of claim 5 wherein the folding back of said integral end portion of the tape is effected by bending it up and then squeezing together said portion and that part of the tape facing said portion by the pressing thereof against the oncoming leading end of the case being fed forward.

7. The method of claim 6 wherein the pressing is effected by a roller and the bending up of said integral end portion is effected by having said end reach of the tape extend over the roller and thence over a pocket one side of which is defined by the roller, and forcing the tape into said pocket.

8. The method of claim 7 wherein the tape is forced into the pocket by directing a blast of air on the tape to blow the tape into the pocket.

9. The method of claim 7 wherein the roller moves up said leading end of the case and then presses the tape down on said flaps at the top of the case as the case is fed forward, and wherein the pocket is defined by a pocket-forming member which moves with the roller and to a retracted position clear of the loop as the roller moves up.

10. The method of claim 9 wherein the tape is forced into the pocket by directing a last of air on the opposite face of the tape, which is its adhesive face, to blow the tape into the pocket and thereby form a loop of the tape at the end thereof in the pocket.

11. Apparatus for taping a case having a closure comprising two folded-over flaps having adjoining edges, said apparatus comprising means for feeding the case forward in a predetermined path with said adjoining edges extending in the direction of feed, means for guiding a continuous length of tape having adhesive on one face thereof from a supply thereof toward said path for pressing of the tape against the case to adhere it to said margins as the case is fed forward in said path, means for pressing the tape against the case, the tape being pulled from the supply by the case, means for severing the tape transversely to provide a length thereof for adhereing to said margins along said adjoining edges, and means for at least partially folding an integral end portion of the tape back on said face of the tape prior to the pressing of the tape against the case adjacent said integral end portion of the tape, said end portion being adhered to the tape to form a tab which is unadhered to the case for being grasped and pulled to peel the tape away from the case.

12. Apparatus as set forth in claim 11 wherein said folding means is operable to fold back the leading end of the tape.

13. Apparatus as set forth in claim 12 wherein said folding means is located in said path for engagement of the leading end of the case with said integral end portion of the tape.

14. Apparatus as set forth in claim 13 wherein said folding means is operable partially to fold back the leading end of the tape before engagement thereof by the leading end of the case an the folding is completed by engagement of the leading end of the case with the partially folded leading end of the tape.

15. Apparatus for taping a case having a closure comprising two folded-over flaps having adjoining edges, said apparatus comprising means for pressing a strip of tape having adhesive on one face thereof against the margins of said flaps along said adjoining edges to adhere the tape to said margins, and means operable prior to pressing the tape against said flaps for folding back an integral end portion of the tape on said face of the tape and adhering said end portion to the tape to form a tab which is unadhered to the case for being grasped and pulled to peel the tape away from the case, the case having a top constituting the said closure, a bottom, sides and ends, the flaps and their said adjoining edges extending endwise of the case, comprising means for feeding the case forward endwise toward an end reach of a continuous length of tape issued from a supply thereof, the tape being disposed with the adhesive face thereof in said end reach facing the leading end of the case and being generally centered with respect to said flaps, said integral end portions of the tape being constituted by an end portion of said end reach, said end portion, when folded back, leaving the adhesive on the adjacent part of said end reach, said pressing means comprising a first pressing means for pressing said reach of the tape including said folded-back portion and said adjacent part of said reach against the leading end of the case as the case moves forward, then pressing the tape down on top of the flaps, said apparatus including means for severing the tape to provide a length thereof sufficient to extend down on the trailing end of the case, and said pressing means further comprising a second pressing means for pressing the tape down on the trailing end of the case.

16. Apparatus as set forth in claim 15 wherein the means for folding back of said integral end portion comprises means for bending up said integral end portion, the first pressing means being operable to squeeze together the bent-up portion and that part of the tape facing said bent-up portion by the pressing thereof against the oncoming leading end of the case being fed forward.

17. Apparatus as set forth in claim 16 wherein said first pressing means is a roller and the folding means comprises a pocket-forming member cooperable with the roller to form a pocket, said end reach of the tape extending over the roller and thence over said pocket, and means for forcing the tape into said pocket.

18. Apparatus as set forth in claim 17 wherein the means for forcing the tape into the pocket comprises means for directing a blast of air on the tape to blow the tape into the pocket.

19. Apparatus as set forth in claim 17 having means carrying the roller for movement up said leading end of the case and then to press the tape down on said flaps at the top of the case as the case is fed forward, and wherein the pocket-forming member is carried by said roller-carrying means for movement therewith and for movement relative thereto to a retracted position clear of the tape as the roller moves up.

* * * * *